US008082619B1

(12) United States Patent
Willey

(10) Patent No.: US 8,082,619 B1
(45) Date of Patent: Dec. 27, 2011

(54) DUAL HANDLE ATTACHMENT FOR A SINGLE HANDLE FLOOR CLEANING APPLIANCE AND CONVERSION METHOD THEREOF

(76) Inventor: Jeanne D. Willey, Independence, MO (US)

( * ) Notice: Subject to any disclaimer, the term of this patent is extended or adjusted under 35 U.S.C. 154(b) by 1085 days.

(21) Appl. No.: 11/982,986

(22) Filed: Nov. 6, 2007

(51) Int. Cl.
*A46B 5/02* (2006.01)

(52) U.S. Cl. ..... 15/144.3; 15/143.1; 16/430

(58) Field of Classification Search ..... 16/430; 15/143.1, 228, 144.1, 144.3, 145, DIG. 10, 15/410; 294/57–58; 56/400.17–400.18
See application file for complete search history.

(56) References Cited

U.S. PATENT DOCUMENTS

| | | | | |
|---|---|---|---|---|
| 1,014,776 | A | 1/1912 | Rubel | |
| 2,536,607 | A * | 1/1951 | Jenkins | 56/400.17 |
| 4,155,582 | A * | 5/1979 | Reisner | 294/58 |
| 4,644,740 | A * | 2/1987 | Lee | 56/400.04 |
| 4,958,407 | A * | 9/1990 | Johnson | 16/426 |
| 5,133,101 | A * | 7/1992 | Hauser et al. | 15/143.1 |
| D378,798 | S | 4/1997 | Berti | |
| D411,673 | S | 6/1999 | Biggs et al. | |
| 5,920,944 | A | 7/1999 | Biggs | |
| D468,502 | S | 1/2003 | Silverman | |
| D468,503 | S | 1/2003 | Silverman | |
| 6,742,222 | B2 | 6/2004 | Furr-Britt et al. | |
| D509,414 | S | 9/2005 | Hinden | |

* cited by examiner

*Primary Examiner* — Laura C Guidotti
(74) *Attorney, Agent, or Firm* — Montgomery Patent & Design, LLC; Robert C. Montgomery; Joseph T. Yaksich

(57) ABSTRACT

An auxiliary dual handle device for attachment to a handle of a floor cleaning appliance having a floor, engaging portion includes an elongated member which has a predetermined length and which is manufactured from a predetermined material and a bore which is longitudinally and axially formed in at least a portion of the elongated member and which is sized and shaped to slidingly engage an exterior surface of the appliance handle. There is a left and a right auxiliary handle, each having a first end portion thereof rigidly secured to a user proximal end portion of the elongated member and laterally offset from one another. The elongated member is secured to the appliance handle with fasteners of clamps. There is also provided a single piece dual handle device which is attachable directly to the floor engaging portion of the floor cleaning appliance.

15 Claims, 4 Drawing Sheets

DUAL HANDLE ATTACHMENT FOR A SINGLE HANDLE FLOOR CLEANING APPLIANCE AND CONVERSION METHOD THEREOF

RELATED APPLICATIONS

The present invention was first described in and claims the benefit of Disclosure Document No. 609,152 filed on Nov. 16, 2006.

FIELD OF THE INVENTION

The present invention relates, in general, to handles for various devices and, more particularly, this invention relates to an ergonomic dual handle device for various floor cleaning appliances to relieve physical stress and strain to the user while improving manual control of the floor cleaning appliances and, yet more particularly, the instant invention relates to converting a single elongated handle of a floor cleaning appliance into an ergonomically disposed dual handle arrangement.

BACKGROUND OF THE INVENTION

Floor cleaning appliance having a floor engaging cleaning head and an elongated handle extending therefrom are well known in the art. Perhaps one of the most common long-handled floor cleaning devices seen on a daily basis is that of industrial push style dust mop. They have been used for generations in hospitals, schools, warehouses, office buildings, and other similar industrial and commercial locations to keep the floors clean and free of debris. While they undoubtedly do their job well, it does not mean they cannot be improved. One aspect of push mop utilization in need of most improvement is its ergonomic functionality. This is especially true for those who spend many hours pushing a mop with their hands, arms, and wrists at an uncomfortable angle to one another while twisting and potentially straining the upper body. Additionally, the long handled nature of the mop makes it difficult to control, especially when trying to move the mop from side to side.

Prior to the conception and design of the present invention, efforts have been made to alleviate the need for the user to twist upper body during use of the push style dust mop and to improve control thereof. U.S. Pat No. D509,414 issued to Hinden discloses the design for an ergonomically contoured adjustable handle for use with multiple heads. This design patent does not appear to disclose a device with bilateral handle grips and has a different design than the instant invention.

U.S. Pat. No. 6,742,222 issued to Furr-Britt discloses a dual handle attachment for an appliance. This patent does not appear to disclose a device that possesses a bilateral handle grip and is designed differently than the instant invention.

U.S. Pat. No. D 468,503 issued to Silverman discloses a mop handle similar to a paint brush handle. This design patent does not appear to disclose a device that possesses a bilateral handle grip and is designed differently than the instant invention.

U.S. Pat. No. D 468,502 issued to Silverman discloses a mop handle similar to a paint brush. This design patent does not appear to disclose a device that possesses a bilateral handle grip and is designed differently than the instant invention.

U.S. Pat. No. 5,920,944 issued to Biggs discloses an ergonomic mop apparatus. This patent does not appear to disclose a device that possesses a bilateral handle grip and is designed differently than the instant invention.

U.S. Pat. No. D 411,673 issued to Biggs discloses an ergonomic mop handle. This design patent does not appear to disclose a device that possesses a bilateral handle grip and is designed differently than the instant invention.

U.S. Pat. No. D 378,798 issued to Berti discloses a sponge mop handle. This design patent does not appear to disclose a device that possesses a bilateral handle grip and is designed differently than the instant invention.

U.S. Pat. No. 1,014,776 issued to Rubel discloses a vacuum cleaner. This patent does not appear to disclose a device that possesses a bilateral handle grip and is designed differently than the instant invention.

SUMMARY OF THE INVENTION

According to one aspect, the invention provides an auxiliary dual handle device for attachment to a handle of a floor cleaning appliance having a floor engaging portion. The device includes an elongated member which has a predetermined length and which is manufactured from a predetermined material. A bore is longitudinally and axially formed in at least a portion of the elongated member and which is sized and shaped to slidingly engage an exterior surface of the appliance handle. There is a left and a right auxiliary handle, each having a first end portion thereof rigidly secured to a user proximal end portion of the elongated member and laterally offset from one another. Means is provided for operably securing the elongated member to the appliance handle.

According to another aspect of the invention, there is provided a floor cleaning appliance. The floor cleaning appliance includes a cleaning head which is engageable with a floor surface. A single piece handle member has a first end thereof operably connected to the cleaning head. The single piece handle member includes an elongated portion having such first end formed therein. A dual handle portion is connected to an opposed end of the elongated portion. The handle portion has a left and a right handle each having a first end portion thereof positioned adjacent the opposed end of the elongated portion and having an opposed second end portion thereof extending outwardly from the opposed end of the elongated portion toward a user of the mop.

According to yet another aspect, the invention provides a method of converting an elongated handle of a floor cleaning appliance into an ergonomically disposed dual handle arrangement. The method includes the step of providing a dual auxiliary handle device having an elongated hollow member and a first and second auxiliary handle disposed on and secured to one end thereof. Then, sliding the elongated hollow member, starting with an end which is opposed to the one end, onto the elongated appliance handle of the floor cleaning appliance. Next, positioning the first and second auxiliary handle at a predetermined working height. Aligning the first and second auxiliary handle in a predetermined direction relative to a floor engaging portion of the floor cleaning appliance. Finally, securing the elongated hollow member to the elongated handle of the floor cleaning appliance.

It is, therefore, one of the primary objects of the present invention to provide an ergonomic dual handle device for various floor cleaning appliances.

Another object of the present invention is to provide a dual handle device for floor cleaning appliances that relieves physical stress and strain to the user.

Yet another object of the present invention is to provide a dual handle device for floor cleaning appliances that improves manual control of the floor cleaning appliances.

A further object of the present invention is to provide a dual handle device for floor cleaning appliances that is simple to install.

Yet a further object of the present invention is to provide a dual handle device for floor cleaning appliances that is economical to manufacture.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| DESCRIPTIVE KEY | |
|---|---|
| 10 | dual handle device |
| 20 | auxiliary handle assembly |
| 20a | left auxiliary handle |
| 20b | right auxiliary handle |
| 21 | handgrip |
| 22 | attachment |
| 23 | sleeve |
| 24 | fastener |
| 25 | riser |
| 26 | bore |
| 27 | proximal end |
| 28 | distal end |
| 29 | aperture |
| 30 | dust mop handle |
| 35 | dust mop head |
| 40 | user |
| 45 | clamping portion |
| 49 | notch |
| 50 | upper clamp flange |
| 51 | lower clamp |
| 52 | bolt |
| 53 | nut |
| 54 | curved upper clamp portion |
| 55 | upper clamp flange |
| 60 | handle device |
| 61 | stem |
| 62 | proximal end |
| 64 | distal end |

DETAILED DESCRIPTION OF THE PREFERRED EMBODIMENT

Figure 1:
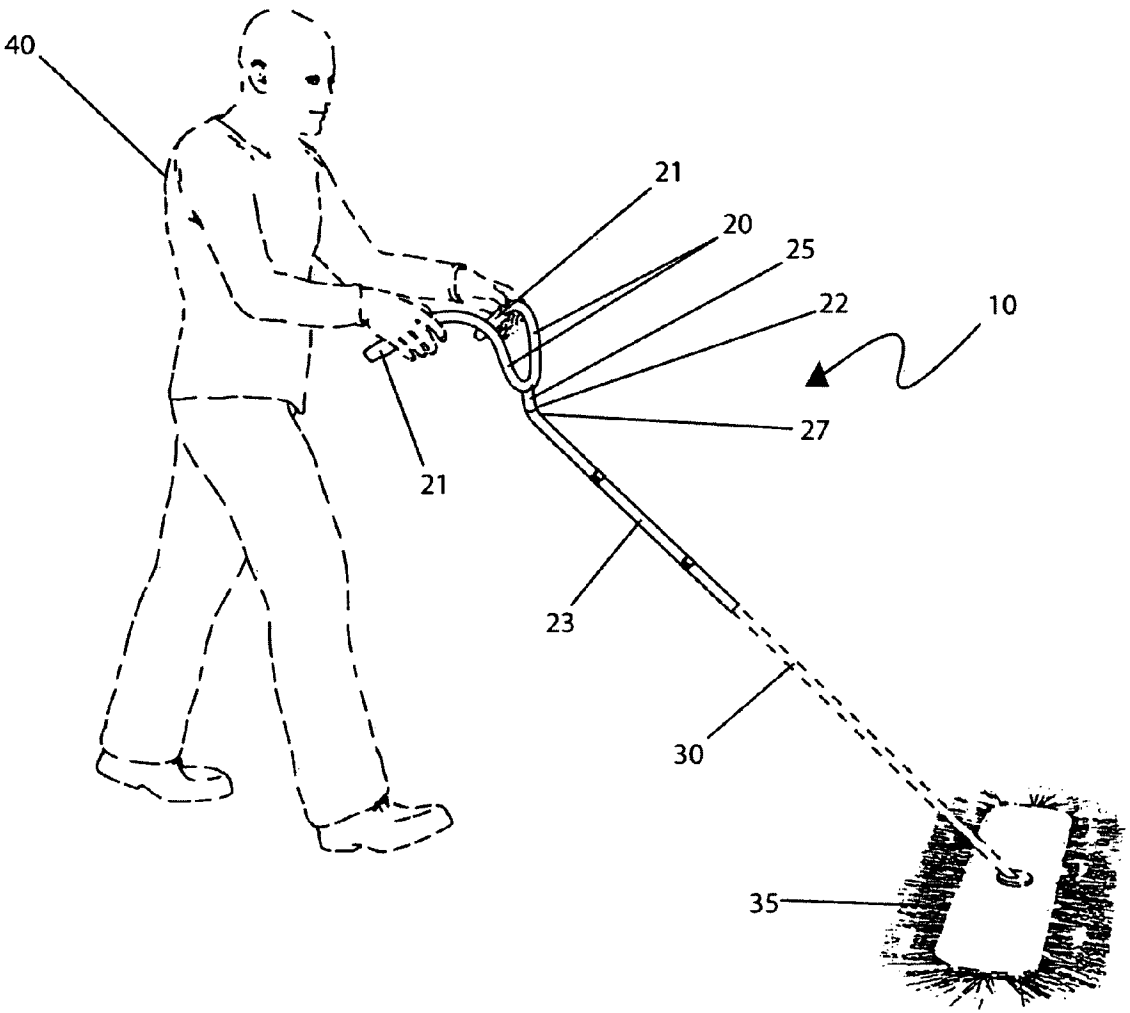
FIG. 1 is an environmental view of a dual handle attachment device for a floor cleaning appliance, such as dust mop, which is constructed in accordance with a presently preferred embodiment of present invention.
Figure 2:
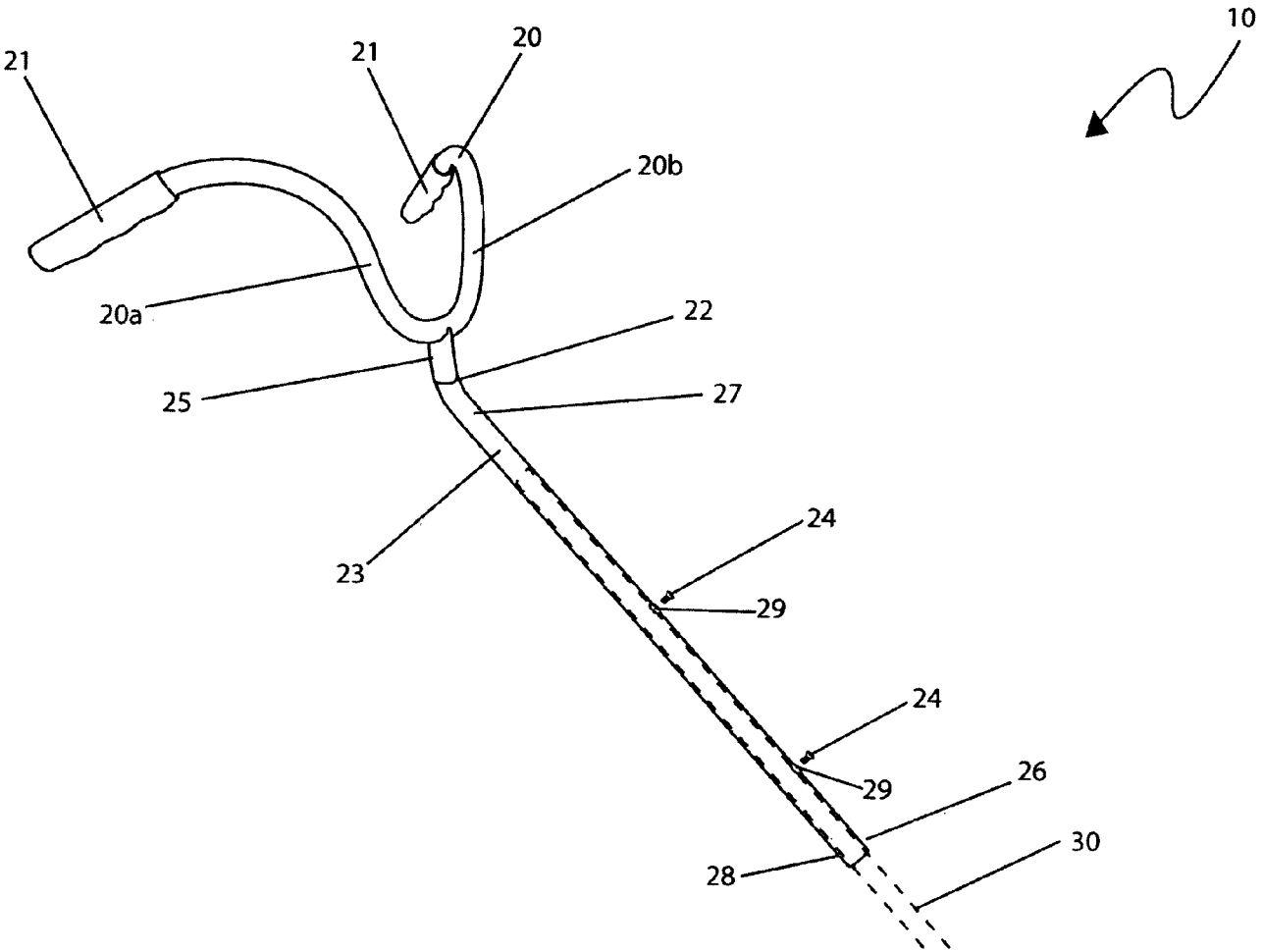
FIG. 2 is a perspective view of the dual handle attachment device of FIG. 1.

The best mode for carrying out the invention is presented in terms of its preferred embodiment, herein depicted within FIGS. 1 and 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

It is to be understood that the definition of a floor cleaning appliance includes but is not limited to vacuum cleaner, large push broom, mop, squeegee, and the like devices which include a floor engaging cleaning portion and an elongated handle connected to and extending therefrom.

The present invention describes a device and method for a dual handle attachment for floor cleaning appliances (herein described as the "device"), generally designated as 10, which provides means to convert a single elongated handle of such appliance into an ergonomic dual grip handle. The present invention is illustrated and described in combination with a conventional dust mop 30, although it will be apparent to those skilled in the relevant art that the present invention may be applied to other single handle floor cleaning devices and as such should not be interpreted as a limiting factor of the device 10 of the present invention.

The device 10 can be connected to most sizes of industrial dust mop handles 30 commonly used to sweep floors at schools, warehouses, hospitals and the like. In place of the standard straight mop handle 30 extending from a mop head 35 to user's hands, an attachable sleeve 23 and auxiliary handle assembly 20 slips over and is secured to the mop handle 30. The invention 10 enables a user 40 to use two hands for improved control of the dust mop handle 30 and apply leverage onto the mop head 35 in an ergonomic manner without twisting the upper body portion.

Reader's attention is now directed to FIG. 1, which discloses an environmental view of the device 10, constructed in accordance with the presently preferred embodiment of the invention. The device 10 includes an auxiliary handle assembly 20 including a left and a right auxiliary handle, 20*a* and 20*b* respectively, a pair of handgrips 21, and a sleeve 23. The auxiliary handle assembly 20 provides leverage means to manipulate an attached dust mop head 35 in a forward and backward, or side-to-side motion with minimal effort. The auxiliary handle assembly 20 also provides an ergonomic design to relieve strain to a user's 40 hands wrists, forearms and upper body. The auxiliary handle assembly 20 extends towards the user 40 and is positioned at an ergonomic working height providing a grasping angle which is generally perpendicular to the longitudinal axis of the sleeve portion 23, thereby resulting in an improved wrist angle when compared to that of a conventional dust mop handle 30. The ergonomic handgrips 21 lower the required gripping force applied by the user 40. It is also envisioned that the length of the dust mop handle 30 may be modified, for example by shortening, to provide a suitable operating elevation or the working height for the device 10 based upon the user's 40 preference.

Referring now to FIG. 2, a perspective view of the device 10 of FIG. 1 is disclosed. As was noted above, the device 10 includes the auxiliary handle assembly 20, the pair of handgrips 21, a riser 25, an attachment 22, the sleeve 23, and a plurality of fasteners 24.

The sleeve 23 is formed as an elongated member and includes a bore 26 which is longitudinally and axially formed in at least a portion of the sleeve 23 and which is sized and shaped to slidingly engage an exterior surface of the mop handle 30. Each of the left and right auxiliary handle, 20*a* and 20*b* respectively has a first end portion thereof rigidly secured to a user proximal end portion of the sleeve 23 and laterally offset from one another. Preferably, the first end portion of the each auxiliary handle 20*a*, 20*b* has one of a curved and a bent shape. It is also presently preferred for opposed second end portion of the each auxiliary handle 20*a*, 20*b* to diverge from one another and have a generally straight shape. To facilitate ergonomic grasping of the device 10, the middle portion of each auxiliary handle 20*a*, 20*b* which connects the first end portion with the second end portion has one of a curved and a bent shape. It is further presently preferred for the left and right auxiliary handles 20*a*, 20*b* to be formed integral with one another as a single piece member, wherein each auxiliary handle 20*a*, 20*b* converges in an expected manner toward a central location and are joined at the single riser 25. The riser 25 is preferably inclined upwardly at a predetermined angle relative to the longitudinal axis of the sleeve 23 when the device 10 is attached to the mop handle 30.

The auxiliary handle assembly 20 is envisioned to be of a durable construction using methods such as a welded metal assembly, plastic injection molding or similar construction. The auxiliary handle assembly 20 is envisioned to be made using light-weight materials such as plated steel tubing, aluminum alloy tubing, fiber-filled plastic, or the like.

The handgrips 21 are envisioned to be similar to those found on bicycles or hand tools and made using high-friction materials such as silicone rubber, plastic, or the like. The handgrips 21 are further envisioned to be attached to the auxiliary handles 20*a*, 20*b* using methods such as friction fit, adhesives, rivets, or the like.

An attachment 22 located at the proximal end 27 of the sleeve 23 comprises a rigid connection from the riser 25 of the auxiliary handle assembly 20 to the sleeve 23. The attachment 22 may be produced using various methods such as welding, press-fit, adhesives, or the like or may be formed integral with the sleeve 23 and the auxiliary handle assembly 20.

Means is provided for securing, preferably rigidly, the sleeve 23 to the dust mop handle 30. In accordance with the presently preferred embodiment of the invention, such securing means includes at least one, and preferably, a plurality of fasteners 24 such as wood-screws, set-screws, rivets, bolts, or the like. If required, an aperture 29 will be formed through the wall portion of the sleeve 23 to receive the fastener 24. However, a variety of clamping and fastening systems may be provided which work equally well and as such should not be interpreted as a limiting factor of the present invention 10 (see FIG. 3*a*). The sleeve 23 is envisioned to provide a sufficient overlapping length of approximately eighteen (18) to thirty-six (36) inches along the dust mop handle 30, thereby resulting in a stabile connection. The sleeve 23 is envisioned to be made of similar materials as the auxiliary handle assembly 20.

Figure 3B:
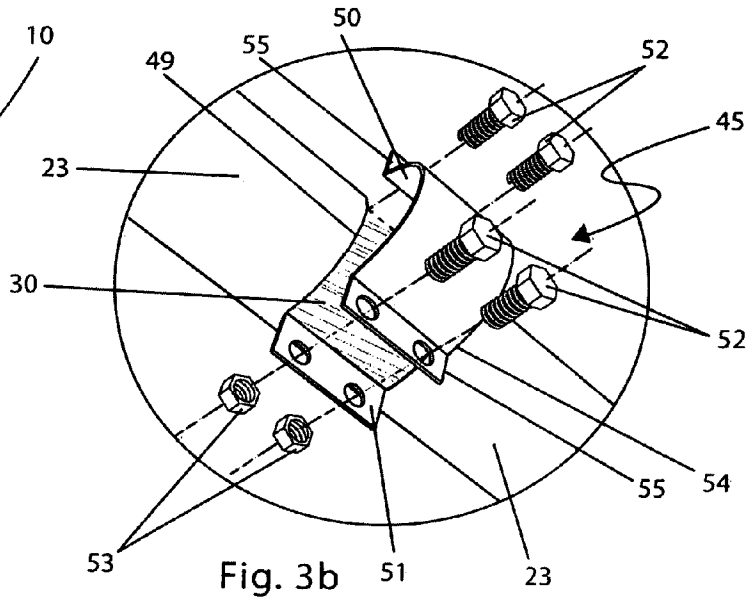
FIG. 3*b* is a close-up view of a clamping portion of the dual handle attachment device of FIG. 3*a*; and, FIG. 4 is an environmental view of an ergonomic dual handle device for a floor cleaning appliance, which is constructed in accordance with a second alternate embodiment of the present invention.
Figure 3A:
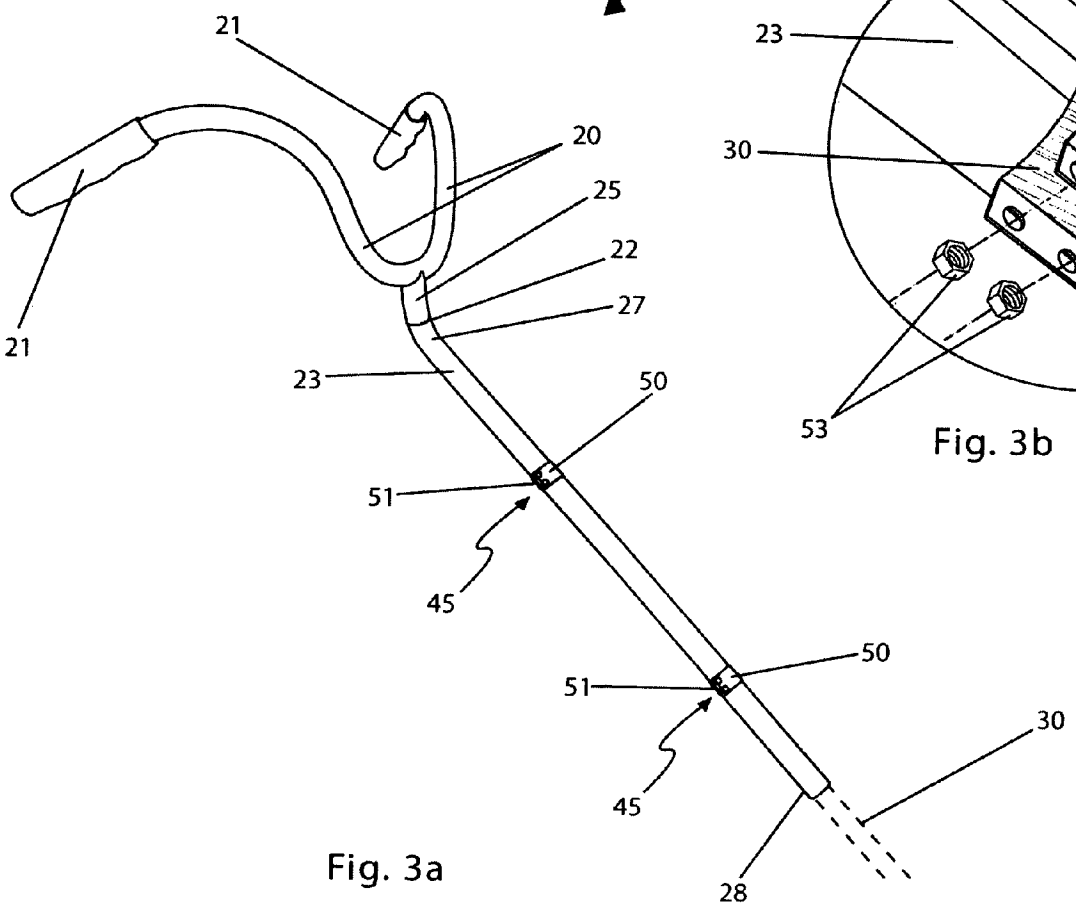
FIG. 3*a* is a perspective view of the dual handle attachment device for a floor cleaning appliance, which is constructed in accordance to a first alternate embodiment of the present invention.
Figure 4:
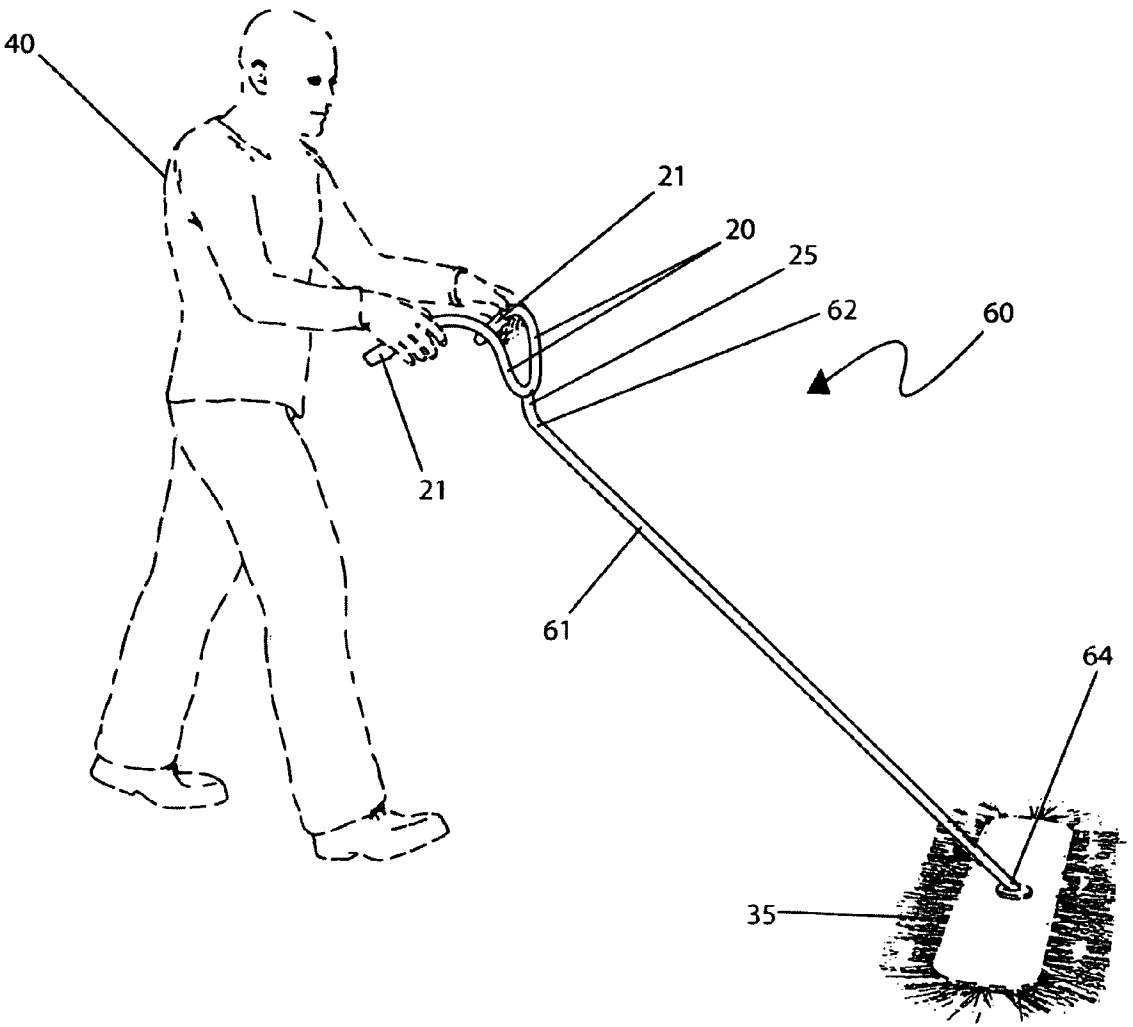

Referring now to FIGS. 3*a* and 3*b*, there is shown a perspective and close-up view, respectively, of the device 10, secured to the mop handle 30 in accordance with an alternate embodiment of the present invention. Illustrated here is an alternate securing means, generally designated as 45, which provides minimum damage to the dust mop handle 30 resulting from application of the device 10 thereto. The clamping means 45 has an upper clamp 50, lower clamp flanges 51, four (4) bolts 52, and four (4) nuts 53. It is contemplated that a plurality of clamping means 45 may be applied in the present invention to secure the sleeve 33 to the mop handle 30 as best shown in FIG. 3*a*. Preferably, a pair of clamping means 45 is provided with a first clamping means 45 disposed adjacent to and spaced from the distal end 28 of the sleeve 23 while a second clamping means 45 is disposed adjacent to and spaced from the proximal end 27 of the sleeve 23 while still being engageable with the mop handle 30.

The lower planar clamp flanges 51 are disposed on and secured to the exterior surface of the sleeve 23, and preferably being formed integral therewith. The lower clamp flanges 51 are aligned with a notch 49 formed in the sleeve 23 and sized to receive a middle curved portion 54 of the upper clamp 50. The middle curved portion 54 of the upper clamp 50 has generally similar diameter as the diameter of the exterior surface of the dust mop handle 30. A pair of planar flanges 55 extends outwardly from the middle curved portion 54. The lower clamp flanges 51 further provide an attachment means to a cooperating flange 55 of the upper clamp 50. The upper clamp 50 and the lower clamp flanges 51 comprise a fastening means to one another along outer extended planar flanges via bolts 52 and nuts 53. The upper clamp 50 provides an interfering and clamping surface to the dust mop handle 30 as the bolts 52 are tightened with nuts 53. The upper clamp 50 may also provide additional methods of clamping such as converging diameters, knurled contact surfaces, various protrusions, or the like to secure the sleeve 23 to the dust mop handle 30. The upper clamp 50, the bolts 52, and the nuts 53 are envisioned to be made using durable materials such as plated steel, aluminum alloy, or the like.

It is envisioned that other styles and configurations of the present invention can be easily incorporated into the teachings of the present invention, and only one particular configuration shall be shown and described for purposes of clarity and disclosure and not by way of limitation of scope.

The presently preferred embodiment of the invention can be utilized by the common user in a simple and effortless manner with little or no training. After initial purchase or acquisition of the device 10, it would be installed as indicated in FIGS. 1-2.

The method of converting the existing mop handle 30 with the device 10 may be achieved by performing the following steps: sliding the sleeve 23 portion of the device 10 over the end of the dust mop handle 30 until a desired working height of the auxiliary handle assembly 20 is obtained; trimming the length of the dust mop handle 30 may be required to obtain an ergonomic working height for the device 10; orientating and aligning the auxiliary handle assembly 20 with respect to the dust mop head 35; attaching the sleeve 23 to the dust mop handle 30 using the provided fasteners 24 (some pre-drilling of the dust mop handle 30 may be necessary); grasping the pair of handlebar grips 21 firmly and performing the sweeping task; and, benefiting from the improved control of the dust mop head 35 as well as enjoying the ergonomic benefits afforded the user 40 while using the present invention 10.

The method of installing and utilizing the alternate embodiment of the device 10 as illustrated in FIG. 3*a*, may be achieved by performing the following alternate step: in lieu of attaching the sleeve 23 to the dust mop handle 30 using fasteners 24, attachment of the upper clamp 50 to the lower clamp flanges 51 using the provided bolts 52 and nuts 53 would be required to secure the device 10 to the dust mop handle 30.

While the above described embodiments provide for a device 10 that enables ease and simplicity of retrofitting mop handles 30 currently in use, the present invention also provides for a novel mop handle, generally designated as 60, wherein the auxiliary handle assembly 20 is formed integral with a straight elongated stem portion 61 at a first end 62 thereof as a single piece member. The second end 64 of the handle 60 is operably and directly connected to the mop head 35 in accordance with any conventional connection techniques. The elongated stem portion 61 may be formed as a hollow cylindrical portion. It is presently preferred for such handle 60 to be economically manufactured from a rigid polymer material by a molding process. The use of polymer material also reduces the overall weight of the handle 60. However, it is within the scope of the present invention to use other materials for constructing handle 60.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. In combination with a floor cleaning appliance having a floor engaging portion and a handle attached to and extending therefrom, an auxiliary dual handle device for attachment to said appliance handle, said device comprising:

(a) an elongated member which has a predetermined length and which is manufactured from a predetermined material;

(b) a bore which is longitudinally and axially formed in at least a portion of said elongated member and which is sized and shaped to slidingly engage an exterior surface of said appliance handle;

(c) a left and a right auxiliary handle, each having a first end portion thereof rigidly secured to a user proximal end portion of said elongated member and laterally offset from one another; and, (d) means for operably securing said elongated member to said appliance handle, further including:

(i) a pair of first planar clamp flanges secured to exterior surface of said elongated member and outwardly extending therefrom;

(ii) a notch formed in a wall portion of said elongated member in alignment with said pair of first planar clamp flanges;

(iii) a clamp member having a middle portion shaped to abutingly engage said exterior surface of said appliance handle and a pair of outwardly extending second planar flanges cooperating with said pair of first planar flanges when said middle portion thereof is positioned within said notch in abutting engagement with said exterior surface of said appliance handle; and (iv) a plurality of threaded screws and nuts joining said first and said second planar flanges by way of complimentary apertures formed therethrough.

2. The device, according to claim 1, wherein said first end portion of said each auxiliary handle has one of a curved and a bent shape.

3. The device, according to claim 1, wherein a second end portion of said each auxiliary handle is diverging from one another.

4. The device, according to claim 1, wherein a second end portion of said each auxiliary handle has a generally straight shape.

5. The device, according to claim 1, wherein a middle portion of said each auxiliary handle which connects said first end portion with said a second end portion thereof has one of a curved and a bent shape.

6. The device, according to claim 1, wherein said right auxiliary handle and said left auxiliary handle are formed integral with one another as a single piece member.

7. The device, according to claim 1, wherein said user proximal end portion of said elongated member includes a riser portion which inclined generally upwardly and at an angle relative to a longitudinal axis of said elongated member when said device is attached to said appliance handle.

8. The device, according to claim 1, wherein said device further includes a pair of grip members each operably attached to a respective second end portion of said left and said right auxiliary handle.

9. The device, according to claim 8, wherein said each grip member is manufactured from a high-friction material.

10. The device, according to claim 1, wherein said securing means includes at least one fastener extending through at least one aperture formed in a wall portion of said elongated member into said appliance handle.

11. A floor cleaning appliance comprising;

(a) a cleaning head engageable with a floor surface; and, (b) a single piece handle member having a first end thereof operably connected to said cleaning head, said single piece handle member including:

(i) an elongated portion having said first end formed therein, and, (ii) a dual handle portion connected to an opposed end of said elongated portion, said handle portion having a left and a right handle each having a first end portion thereof positioned adjacent said opposed end of said elongated portion and having an opposed second end portion thereof extending outwardly from said opposed end of said elongated portion toward a user of said appliance; and, (iii) means for operably securing said elongated portion to said appliance handle member, further including:

(a) a pair of first planar clamp flanges secured to exterior surface of said elongated portion and outwardly extending therefrom;

(b) a notch formed in a wall portion of said elongated portion in alignment with said pair of first planar clamp flanges;

(c) a clamp member having a middle portion shaped to abutingly engage said exterior surface of said appliance handle member and a pair of outwardly extending second planar flanges cooperating with said pair of first planar flanges when said middle portion thereof is positioned within said notch in abutting engagement with said exterior surface of said appliance handle member; and, (d) a plurality of threaded screws and nuts joining said first and said second planar flanges by way of complimentary apertures formed therethrough.

12. The floor cleaning appliance, according to claim 11, wherein a middle portion of said each left and right handle has one of a curved and a bent shape.

13. The floor cleaning appliance, according to claim 12, wherein said floor cleaning appliance further includes a pair of grip members each operably attached to a respective second end portion of said left and said right handle.

14. A method of converting an elongated handle of a floor cleaning appliance into an ergonomically disposed dual handle arrangement, said method comprising the steps of:

(a) providing a dual auxiliary handle device having an elongated hollow member and a first and second auxiliary handle disposed on and secured to one end thereof;

(b) sliding the elongated hollow member, starting with an end which is opposed to said one end, onto said elongated appliance handle of said floor cleaning appliance;

(c) positioning said first and second auxiliary handle at a predetermined working height;

(d) aligning said first and second auxiliary handle in a predetermined direction relative to a floor engaging portion of said floor cleaning appliance; and, (e) securing said elongated hollow member to said elongated handle of said floor cleaning appliance:

wherein said method includes the additional step of reducing length of said elongated appliance handle prior to sliding said elongated hollow member thereonto in step (b) so as to position said first and second auxiliary handle at said predetermined working height in step (c).

15. The method, according to claim 14, wherein said step of securing said elongated hollow member includes the step of using at least one fastener and the additional step of forming at least one aperture in said elongated appliance handle to accept said at least one fastener.

* * * * *